US006332544B1

(12) United States Patent
Mitani

(10) Patent No.: US 6,332,544 B1
(45) Date of Patent: Dec. 25, 2001

(54) SYSTEM FOR RAPIDLY CHECKING AND SORTING AN ARTICLE WITH LOW COST

(75) Inventor: Seiji Mitani, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/495,706

(22) Filed: Feb. 1, 2000

(30) Foreign Application Priority Data

Feb. 1, 1999 (JP) ..... 11-024322

(51) Int. Cl.[7] ..... B07C 5/00
(52) U.S. Cl. ..... 209/559; 209/583; 235/375
(58) Field of Search ..... 209/559, 577, 209/583, 552, 563; 235/375

(56) References Cited

U.S. PATENT DOCUMENTS 4,622,875 * 11/1986 Emery et al. ..... 209/583 X
5,640,002 * 6/1997 Ruppert et al. ..... 235/472
5,966,457 * 10/1999 Lemelson ..... 382/141
6,124,561 * 9/2000 Luckhurst et al. ..... 209/583

FOREIGN PATENT DOCUMENTS 3-106718 * 5/1991 (JP) ..... 209/583

* cited by examiner

*Primary Examiner*—Tuan N. Nguyen
(74) *Attorney, Agent, or Firm*—Sughrue Mion, PLLC

(57) ABSTRACT

A system is for sorting an article on shipping the article. The article has a tag label in which a symbol is written. The article has an ID tag in which tag information is written. The article is conveyed on a conveyer. A first detector detects the article conveyed on the conveyer to produce a first detection signal. A second detector is located downstream of the first detector and detects the article conveyed on the conveyer to produce a second detection signal. A control device controls a symbol reading device in response to the first detection signal to make the symbol reading device read the symbol as read-out symbol information out of the tag label. The control device controls an ID tag writing device in response to the second detection signal to make the ID tag writing device write the tag information in the ID tag in accordance with the read-out symbol information. The article is sorted on the basis of the tag information written in the ID tag.

9 Claims, 2 Drawing Sheets

SYSTEM FOR RAPIDLY CHECKING AND SORTING AN ARTICLE WITH LOW COST

BACKGROUND OF THE INVENTION

This invention relates to a system for checking and sorting an article in a physical distribution center.

In general, a sender attaches a tag label to an shipping article on shipping the article. A shipping Address and name is written as a tag name on the tag label. The shipping article is sorted on the basis of the shipping name in a physical distribution center. Furthermore, the owner may transmit shipping data to the physical distribution center by an on-line system. The shipping data is used for specifying the shipping article. In the physical distribution center, it is necessary to check the shipping name with the shipping data before the shipping article is shipped to a receiver.

However, the above-mentioned check is carried out by human hands. As a result, it is difficult to efficiently ship the shipping article to the receiver in the physical distribution center with a low cost.

SUMMARY OF THE INVENTION

It is therefore an object of this invention to provide a system for rapidly checking and sorting a shipping article with a low cost.

Other objects of this invention will become clear as the description proceeds.

According to this invention, there is provided a system for sorting an article on shipping the article. The article has a tag label in which a symbol is written. Furthermore, the article has an ID tag in which tag information is written. The system comprises symbol reading means for reading the symbol out of the tag label to produce read-out symbol information, ID tag writing means for writing the tag information in the ID tag in accordance with the read-out symbol information, conveyer means for conveying the article therethrough, first detecting means for detecting the article conveyed on the conveyer means to produce a first detection signal, second detecting means located downstream of the first detecting means for detecting the article conveyed on the conveyer means to produce a second detection signal, and control means for controlling the symbol reading means in response to the first detection signal to make the symbol reading means read the symbol out of the tag label, the control means controlling the ID tag writing means in response to the second detection signal to make the ID tag writing means write the tag information in the ID tag in accordance with the read-out symbol information. The article is sorted on the basis of the tag information written in the ID tag.

Figure 1:
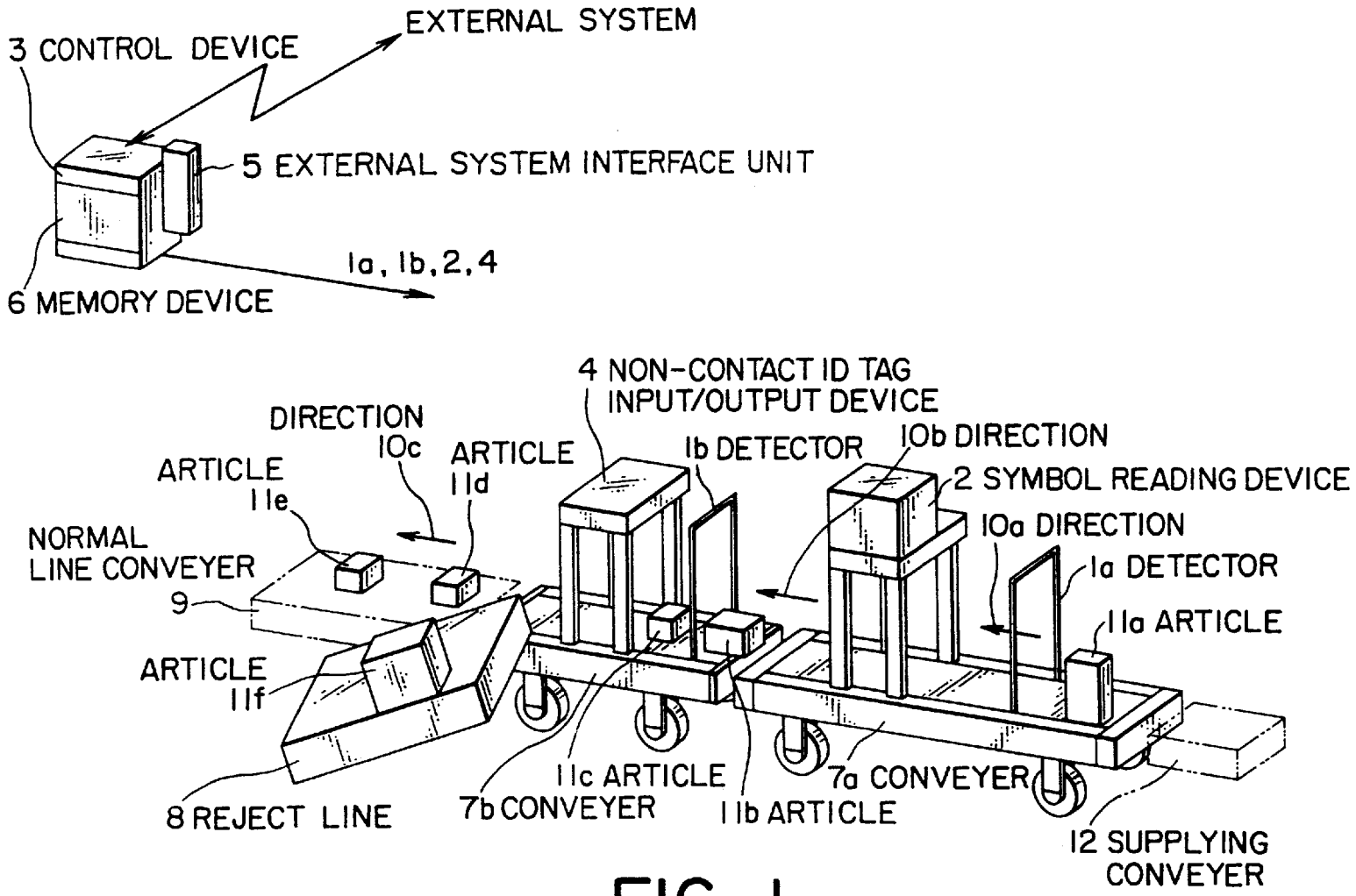
FIG. 1 shows a view of a checking and sorting system according to a preferred embodiment of this invention.

DESCRIPTION OF THE PREFERRED EMBODIMENT:

Referring to FIG. 1, the illustrated checking and sorting system comprises pass-through detectors 1*a* and 1*b* for detecting an article 11(suffixes omitted) passing therethrough, a symbol reading device 2 for reading a symbol on a tag label attached on the article 11, a non-contact ID tag input/output device 4 for carrying out a reading operation and a writing operation of an ID tag, a memory device 6, and an external interface unit 5. A control device 3 stores data in the memory device 6. From the pass-through detectors 1*a* and 1*b* or the symbol reading device 2, the data is supplied to the control device 3. The control device 3 controls the pass-through detectors 1*a* and 1*b* and the symbol reading device 2. The control device 3 further controls the non-contact ID tag input/output device 4 to make the non-contact ID tag input/output device 4 carry out the reading operation and the writing operation of an ID tag. Furthermore, the checking and sorting system comprises conveyers 7*a* and 7*b* and a rejecting line 8.

Figure 2:
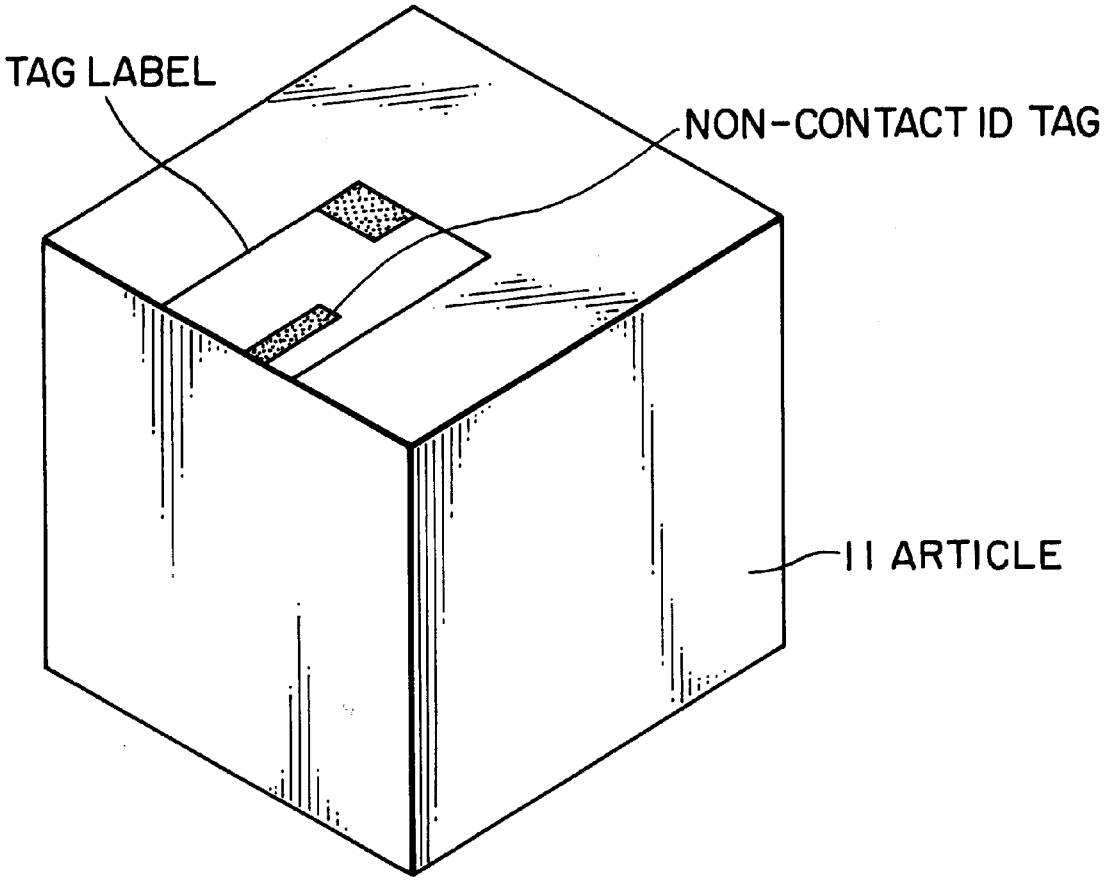
FIG. 2 shows an example for describing a shipping article having a tag label with a non-contact ID tag.

Referring to FIG. 1 in addition to FIG. 2, the article 11 has the tag label in which a symbol is written. The symbol may be, for example, bar codes, OCR characters, or handwriting characters. The tag label has an ID tag in which data is not written. The article 11 is directly supplied to the conveyer 7*a* by a supplying conveyer 12 or human hands. The article 11 is conveyed by conveyers 7*a* and 7*b* towards a direction 10 (suffixes omitted). Each of the pass-through detectors 1*a* and 1*b* detects the article 11 passing therethrough to supply a pass-through timing signal to the control device 3. The pass-through detector 1*b* is positioned at a downstream of the pass-through detector 1*a*.

When the control device 3 is supplied with the timing signal of the pass-through detector 1*a,* the control device 3 controls the symbol reading device 2 to make the symbol reading device 2 read the symbol written on the tag label of the article 11. The symbol reading device 2 supplies the symbol as read-out information to the control device 3.

The control device 3 is supplied with shipping data from an external system through the external interface unit 5. The shipping data is stored in the memory device 6. The control device 3 retrieves the shipping data in accordance with the read-out information in order to obtain shipping or additional information. The shipping information has a delivery number (No.) and a delivery area. After the article 11 passes the pass-through detector 1*b*, the control device 3 controls the non-contact ID tag input/output device 4 in synchronism with a conveyer speed to make the non-contact ID tag input/output device 4 write the shipping information in the ID tags. The conveyer speed is preliminarily set as conveyer information in the control device 3. On setting the conveyer information, an input unit such as a keyboard unit may be used although the input unit is not illustrated in FIG. 1.

The non-contact ID tag input/output device 4 supplies the control device 3 with a status representative of whether or not a normal write-in operation is carried out. On the basis of the status, the control device 3 sorts the article in synchronism with the conveyer speed. More particularly, the control device 3 sorts the article to the rejecting line 8 in synchronism with the conveyer speed when the normal write-in operation is not carried out.

The control device 3 supplies the status to the external system through the external interface unit 5.

As described above, the control device 3 controls the non-contact ID tag input/output device 4 on the basis of the symbol of the tag label attached on the article in order that the non-contact ID tag input/output device 4 write the shipping information in the ID tag.

When the shipping information is not normally written in the ID tag of the article, the article is delivered to the rejecting line 8. As a result, it is possible to sort the articles in accordance with whether or not the normal write operation is carried out to the ID tag.

In the manner described above, the non-contact ID tag input/output device 4 write the shipping information in the ID tag on the basis of the symbol such as the delivery number of the tag label which is attached on the article. As a result, it is possible to automatically write the shipping information in the ID tag attached on the article.

After the non-contact ID tag input/output device 4 write the shipping information in the ID tag attached on the article, as descried above, the article is delivered to a next step in which an automatic shipment is carried out. In the next step, the automatic shipment is carried out in accordance with the tag information written in the ID tag attached on the article. Inasmuch as the automatic shipment is carried out in accordance with the tag information, it is possible to prevent the article from an error delivery. Furthermore it is possible to efficiently carry out shipment with a low cast.

While this invention has thus far been described in conjunction with the preferred embodiment thereof, it will readily be possible for those skilled in the art to put this invention into practice in various other manners.

What is claimed is:

1. A system for sorting an article on shipping said article, wherein:

said article has a tag label in which a symbol is written, said article having an ID tag in which tag information is written;

said system comprising:

symbol reading means for reading said symbol out of said tag label to produce read-out symbol information; and ID tag writing means for writing said tag information in said ID tag in accordance with said read-out symbol information and supplying a status representative of whether or not a normal write-in operation is carried out;

said article being sorted on the basis of said tag information written in said ID tag.

2. A system as claimed in claim 1, wherein said symbol is a bar-codes or OCR characters.

3. A system as claimed in claim 1, wherein said ID tag writing means is a device of non-contact type.

4. A system as claimed in claim 1, wherein said system further comprises:

conveyer means for conveying said article therethrough;

first detecting means located at a first location for detecting said article conveyed on said conveyer means to produce a first detection signal;

second detecting means located at a second location for detecting said article conveyed on said conveyer means to produce a second detection signal, said second location being positioned at a downstream of said first location; and control means for controlling said symbol reading means in response to said first detection signal to make said symbol reading means read said symbol out of said tag label, said control means controlling said ID tag writing means in response to said second detection signal to make said ID tag writing means write said tag information in said ID tag in accordance with said read-out symbol information.

5. A system as claimed in claim 4, wherein said control means has memory means for storing said tag information in correspondence to said symbol.

6. A system as claimed in claim 4, wherein said tag information is supplied as shipping data from an external system to said control means.

7. A system as claimed in claim 4, wherein said control means controls said ID tag writing means in synchronism with a conveying speed of said conveyer means.

8. A system as claimed in claim 4, wherein said control means sorts said article to a rejecting portion in synchronism with said conveying speed when said normal write-in operation is not carried out.

9. A system as claimed in claim 1, wherein said control means supplies said status to an external system.

* * * * *